United States Patent [19]

Kruse et al.

[11] Patent Number: 4,828,749

[45] **Date of Patent: * May 9, 1989**

[54] MULTILAYER DETERGENT TABLETS FOR DISHWASHING MACHINES

[75] Inventors: Hans Kruse, Korshenbroich; Jochen Jacobs, Wuppertal; Theodor Altenschoepfer, Duesseldorf; Peter Jeschke, Neuss, all of Fed. Rep. of Germany

[73] Assignee: Henkel Kommanditgesellschaft auf Aktien, Duesseldorf, Fed. Rep. of Germany

[ * ] Notice: The portion of the term of this patent subsequent to May 9, 2006 has been disclaimed.

[21] Appl. No.: 931,503

[22] Filed: Nov. 17, 1986

[30] Foreign Application Priority Data

Nov. 21, 1985 [DE] Fed. Rep. of Germany ..... 3541146

[51] Int. Cl.[4] ..... C11D 7/36; C11D 17/00; C11D 7/14; C11D 7/16

[52] U.S. Cl. ..... 252/135; 252/174; 252/174.21; 252/DIG. 16; 252/91; 252/99; 252/174.13

[58] Field of Search ..... 252/174, 174.13, 91, 252/99, 135, DIG. 16; 23/313

[56] References Cited

U.S. PATENT DOCUMENTS

| | | | |
|---|---|---|---|
| 2,412,819 | 12/1946 | MacMahon | 252/138 |
| 3,154,494 | 10/1964 | Speak et al. | 252/96 |
| 3,390,092 | 6/1968 | Keast et al. | 252/99 |
| 4,219,436 | 8/1980 | Gromer et al. | 252/135 |
| 4,518,516 | 5/1985 | Godard | 252/174 |
| 4,587,031 | 5/1986 | Kruse et al. | 252/135 |

FOREIGN PATENT DOCUMENTS

| | | |
|---|---|---|
| 0126963 | 4/1984 | European Pat. Off. . |
| 3315950 | 11/1984 | Fed. Rep. of Germany . |
| 430925 | 8/1967 | Switzerland . |

OTHER PUBLICATIONS

Ritschel, "Die Tablette", Ed. Cantor, 1966, p. 313.

*Primary Examiner*—Paul Lieberman
*Assistant Examiner*—John F. McNally
*Attorney, Agent, or Firm*—Ernest G. Szoke; Wayne C. Jaeschke; Real J. Grandmaison

[57] ABSTRACT

A multilayer detergent tablet for dishwashing machines based on alkali metal metasilicates, pentaalkali metal triphosphates, active chlorine compound, and surfactant. The tablet comprises a first cold water-soluble layer of alkali metal metasilicate nonahydrate, pentaalkali metal triphosphate, and a low-foaming nonionic surfactant; and a second layer which dissolves rapidly at increasing water temperatures comprising alkali metal metasilicate, pentaalkali metal triphosphate, and an active chlorine compound.

12 Claims, No Drawings

MULTILAYER DETERGENT TABLETS FOR DISHWASHING MACHINES

BACKGROUND OF THE INVENTION

1. Field of the Invention

This invention relates to detergent tablets, more especially for dishwashing machines, and to their use in the prerinse and main wash cycles of automatic dishwashing machines.

Dishwashing in dishwashing machines generally comprises a prerinse cycle, a main-wash cycle, one or more intermediate rinse cycles, a clear-rinse cycle and a drying cycle. This applies both to domestic and to institutional dishwashing.

Hitherto, it has been standard practice in domestic dishwashing machines, hereinafter referred to as DDWM, to store the detergent in a dispensing compartment which is generally situated in the door of the machine and which opens automatically at the beginning of the main-wash cycle. The previous prerinse cycle is completed solely with cold tapwater flowing into the machine.

In institutional dishwashing machines, hereinafter referred to as IDWM, the preliminary clearing zone corresponds in principle to the prerinse cycle of a DDWM. In machine dishwashing in large kitchens, the detergent fed into the main-wash zone is actually used by overflow in the so-called preliminary clearing zone for the supportive, presoftening removal of food remains adhering to the surfaces to be cleaned. Although there are also IDWM in which the preliminary clearing zone is supplied solely with fresh water, a preliminary clearing zone supplied with detergent solution is more effective more a preliminary clearing zone supplied solely with fresh water.

An object of the present invention is to apply the broad action principle of the preliminary clearing zone of institutional dishwashing machines to domestic dishwashing machines. The addition of detergents to the actual prerinse cycle was originally regarded as one possibility. However, in tests carried out with standard DDWM detergents, it was found that, in addition to the usual dispensing of the detergent through the dispensing compartment in the door, some of the detergent also had to be introduced into the machine itself. However, it is a well-known problem that flow-deficient regions exist both at the bottom of the machine and in the liquor sump of the machine. As a result, the product can never be adequately dissolved and, on completion of the prerinse cycle, has to be pumped off virtually unused.

Scattering detergent into the cutlery basket via the cutlery placed therein is not advisable because irreversible damage can be caused to silver and fine steel.

It has now surprisingly been found that the disadvantages mentioned above do not arise where detergent tablets are used. The introduction of one or more tablets may be effected, for example, in an empty part of the cutlery basket or even elsewhere in the machine.

2. Discussion of Related Art

The use of tablet-form detergents is adequately described in the patent literature. For example, U.S. Pat. No. 3,390,092 describes tablets for dishwashing machines which may be obtained by tabletting a powder-form mixture of sodium silicate having a ratio of $Na_2O$ to $SiO_2$ of from 1:3.25 to 2:1 and a water content of from 0 to 20%, alkali metal phosphates, active chlorine compounds, low-foaming nonionic surfactants compatible with the active chlorine compounds, fillers, such as alkali metal carbonates, chlorides or sulfates, white paraffin oil and tablet binders, and which are said to be storable and transportable.

U.S. Pat. No. 4,129,436 describes tablets which essentially contain the same aforementioned constituents but which are said to show particularly high alkalinity which may be achieved inter alia by the addition of alkali metal hydroxide. However, high alkalinity is unsuitable for the domestic use of the detergents because, unless the detergents are properly handled, it can lead to skin irritations and, in addition, can damage decorative finishes.

According to German Patent Application No. 33 15 950, it is particularly advantageous, so far as the required mechanical strength of detergent tablets and their high dissolving rate are concerned, not merely to tablet the mixtures of the consistuents, but instead initially to prepare a co-granulate from the alkaline-reacting constituents and then to tablet the co-granulate thus prepared under high pressure after the addition of further substances and tabletting aids.

In commercial DDWM, all these tablets are introduced into the dispensing compartment also provided for the addition of powder-form or granular detergents which is only designed to open automatically on completion of the prerinse cycle using cold tapwater. After about 5 to 7 minutes, by which time they have been completely flushed out from the dispenser into the dishwashing liquor by the water, the tablets develop their full activity with increasing water temperature during the 20 to 30 minute long main-wash cycle. When the tablets are introduced, for example through the cutlery basket, they enter the prerinse cycle of the machine, but cause increased damage to decorative finishes on account of excessive alkalinity and/or dissolve too quickly and/or disintegrate too quickly and sink without dissolving into the liquor sump of the machine. Therefore, the quantities of detergent available for the main-wash cycle are no longer adequate.

DESCRIPTION OF THE INVENTION

Accordingly, the main object of the present invention is to provide multilayer, more especially two-layer detergent tablets of which the first layer mainly dissolves in a very short time in the prerinse cycle of the DDWM under the effect of the cold tapwater flowing in, developing very high alkalinity coupled with a good wetting effect. A second layer is intended to correspond in the usual way to current detergent formulations for dishwashing machines and, accordingly, should contain an active chlorine compound. The second layer of the tablets is intended to be dissolved at best only slightly by the cold tapwater in the prerinse cycle, but to dissolve completely in the main wash cycle of DDWM.

Other than in the operating examples, or where otherwise indicated, all numbers expressing quantities of ingredients or reaction conditions used herein are to be understood as modified in all instances by the term "about."

Thus, the present invention relates to multilayer, more especially two-layer, detergent tablets for dish washing machines containing, generally, standard alkaline-reacting components, more especially from the group consisting of alkali metal metasilicates and pentaalkali metal triphosphates, low-foaming nonionic surfactants, active chlorine compounds and tabletting aids, characterized in that, in a first cold water-soluble layer, it contains alkaline metasilicate nonahydrate and pentaalkali metal triphosphate containing from 7 to 22.4% by weight and preferably from 15 to 18% by weight water of crystallization in a weight ratio of from 0:1 to 1:0 and preferably from 0.35:1 to 1:1, based on anydrous compounds, and a low-foaming non-ionic surfactant and, in a second layer which dissolves rapidly at increasing water temperatures, alkali metal metasilicate and pentaalkali metal triphosphate in a ratio by weight of from 2:1 to 1:2 and preferably from 1:1 to 1.7:1, based on anhydrous compounds, and an active chlorine compound.

The alkali metal metasilicate used in the second layer is preferably the anhydrous compound. However, a mixture of anhydrous metasilicate and its nonahydrate in a ratio by weight of at most 1.2:1 may also be used.

To determine the optimal composition of the differently soluble layers, tabletted detergent mixtures were tested for their solubility or rather decomposition properties in order subsequently to obtain a multilayer compact having the desired solubility profile by combination of a composition showing good solubility in cold water with a composition which only shows good solubility at increasing water temperatures.

The desired solubility profile of a two-layer tablet is meant to be understood as substantially complete dissolution of the first layer, but at best only minimal dissolution of the second layer in the prerinse cycle, and rapid and complete dissolution of the remaining tablet layer at increasing water temperatures in the main-wash cycle of any standard domestic dishwashing machine.

The solubility (decomposition) of the tablets was tested as follows using an Engelsmann type E 70 universal tester:

Lying on a 2 mm mesh sieve cloth, the tablets were moved up and down in water at 20° C. in such a way that, at the highest point, the bottom of the tablets was just level with the water surface. The quantity of water was 800 g and the number of up-and-down movements was 25 per minute. The time taken for each individual tablet to decompose or rather dissolve was measured or, where the dissolving times were longer than 5 minutes, the residues on the sieve were reweighed after 5 to 10 minutes.

The results of the tests are shown in Table 1(a) and (b). It can be seen that the granulated raw materials, sodium metasilicate nonahydrate and pentasodium triphosphate having a water of crystallization content of preferably from 15 to 18% by weight, may be used for the layer dissolving rapidly in cold water. A combination of the nonahydrate and the partially hydrated triphosphate was particularly suitable. In the practical application of these tablets, providing their composition has been carefully coordinated and their degree of compression gauged accordingly, this layer decomposed with simultaneous dissolution of the sinking particles (partially hydrated triphosphates and the metasilicate nonahydrate are highly soluble in water). No undissolved particles could be detected in the water pumped off after the prerinse cycle.

An improvement in the wetting of the surfaces to be cleaned by the alkaline detergent components in the prerinse cycle may be obtained by the addition of surfactants. Surfactants are generally incompatible with active chlorine compounds. However, they may be simultaneously used in a two-layer tablet without affecting the chlorine donor providing both compounds are present separated from one another in an other layer. The layer intended for the prerinse cycle has a surfactant content of from 0.5 to 10% by weight, and preferably of from 1 to 5% by weight, based on the weight of the prerinse layer. The surfactant component may be any of the known low-foaming nonionic surfactants, such as ethoxylation products of long-chain alcohols and alkylphenols, the free hydroxyl groups of the polyethylene glycolether residue being replaceable by ether or acetal groups or by polypropylene glycolether residues in order to reduce the tendency towards foaming. Block polymers of ethylene oxide with propylene oxide are also suitable.

The tablet formulations preferably contain as tabletting aids from 0.5 to 2.5% by weight, and preferably from 1 to 2% by weight, of calcium hydrogen phosphate dihydrate to reduce disintegration, and from 1 to 5% by weight, and preferably from 2 to 3% by weight, of sodium acetate, anhydrous to prevent adhesion to equipment.

The quantities in which these tabletting aids, which have no effect on detergency, are used may be increased beyond the ranges mentioned to enable modified formulations to be optimally tabletted. In addition, the sodium acetate content influences the solubility of the tablet. Larger quantities of sodium acetate lead to improved cold-water solubility in the prerinse cycle.

A further improvement in solubility may also be obtained, inter alia, by addition of other readily water-soluble salts, such as sodium chloride for example, although this is generally not necessary if the starting materials are suitably selected. Although standard tabletting aids such as lubricants to improve the tabletting properties, for example stearates, talcum, glycerides, etc., disintegrating agents such as cellulose derivatives, attapulgite, Mg-Al-silicate, etc. and other auxiliaries may also be used in principle, they are undesirable in terms of application and, in addition, burden the formulation in terms of costs and additional inert fillers. According to the invention, there is no need to use these otherwise standard auxiliaries in the production of tablets.

In order to show the mode of action of the two-layer tablet to the user, coloring of the tablet is possible, particularly in the case of the layer intended for the prerinse cycle, although it has surprisingly been found that tabletted, colored raw materials may not dissolve as readily as tabletted, uncolored raw materials. The coloring of sodium metasilicate nonahydrate has the least influence on solubility. The dye may be dissolved or suspended in the surfactant and applied with the surfactant to the nonahydrate by mixing, for example in a Lodige mixer. It is possible to introduce an aqueous dye solution with simultaneous drying by a fluidized-bed process. The colored nonahydrate may then be optionally mixed with other components and, after tabletting, gives a uniformly colored tablet layer. For aesthetic reasons, the tablets may also be formed in colored layers.

Tablets consisting of a mixture of anhydrous sodium metasilicate having a grain fraction of smaller than 0.8 mm and anhydrous pentasodium triphosphate are suitable for the main-wash cycle in the DDWM. The solubility profile of the tablets may be influenced by an addition of sodium metasilicate nonahydrate.

The tabletting properties of raw material mixtures containing substantially anhydrous sodium metasilicate depend on their grain size distribution. A fine-grain fraction (smaller than 0.8 mm) provides for favorable tabletting properties while dust (smaller than 0.2 mm) and unsieved materials (20 to 100% larger than 0.8 mm) lead to mixtures having poor tabletting properties. Where completely anhydrous metasilicates, for example produced by a sintering or fusion process are used, the tablets are mechanically stable even after prolonged storage. Where hydrothermally produced metasilicate having a residual moisture content of approximately 2% is used, the grain size distribution is not a crucial factor. However, after storage under room conditions, the surface of the tablets shows signs of weathering, large tablets also showing a tendency to crack. Accordingly, a residual moisture content of more than 2% in the metasilicate is undesirable.

In addition to the quality of the metasilicates used, the quality of the triphosphate also affects the tabletting properties. Dust-fine products lead to poorer tabletting properties than slightly coarser types.

Metasilicates in anhydrous form and as the nonahydrate, and also anhydrous triphosphate are preferably used in the form of their sodium salts. They are present in the tabletting mixture for the main-wash cycle in a total quantity of from 88 to 98% by weight and preferably in a total quantity of from 95 to 97% by weight.

In addition, active chlorine donors are standard constituents of detergents for DDWM. The preferred active chlorine donor is trichloroisocyanuric acid, although other known solid compounds such as, for example, sodium dichloroisocyanurate, its dihydrate and potassium dichloroisocyanurate, may also be used in standard commercial form without adversely affecting the tabletting properties. The active chlorine donors are used in quantities of from 0.5 to 5.0% by weight and preferably in quantities of from 1.0 to 2.5% by weight, based on the tabletting mixture as a whole.

Finally, substantially the same tabletting aids as described for the prerinse layer may also be added to the main-wash tablet layer in similarly variable quantities.

Standard chlorine-stable dyes and perfumes may also be added to the tabletting mixtures for the mainwash cycle.

On the basis of the test results described in Tables 1(a) and (b), it is possible to prepare multilayer and, more especially, two-layer tablets in which one tablet layer dissolves completely or almost completely in the prerinse cycle, while the other layer dissolves only slightly in the prerinse cycle and then completely dissolves in the main-wash cycle of the DDWM.

Two-layer tablets are formed in rotary presses provided with two metering stations and two compression stations (for example Fette/Perfecta 3002, Fette/P3, Kilian/RU-ZS). The first metering station contains the mixture of the detergent layer of smaller mass, generally for the prerinse cycle. The cavities in the rotating cavity disc are filled therewith. At the first compression station, this material is subjected to preliminary compression. Thereafter, at the second metering station, the pre-compressed first layer is covered with the second detergent mixture intended for the main-wash cycle. At the second compression station, the two-layer tablet is compressed and then ejected from the cavity by the bottom force.

In the tests carried out and described hereinafter, this method of production was completed in a manual eccentric press of the Exacta type made by Fette. The tabletting conditions substantially correspond to those for the rotary press.

The detergent layer of smaller mass for the prerinse cycle was introduced into the cavity of the press and precompressed.

By turning the handwheel backwards, the top force was removed from the cavity. The bottom force remained together with precompressed material in the lowest position in the cavity. The detergent layer intended for the main-wash cycle was then introduced into the cavity and compressed with the prerinse detergent layer already present to form the tablet having the bending strength required for the desired solubility profile. Examples of the tablets thus obtained and their properties are shown in Table 2. The layer for the prerinse cycle is designated as layer 1 in the Table and the layer for the main-wash cycle as layer 2.

Tabletting may be carried out with cavity lubrication using standard lubricants such as, for example, paraffin oil, almond oil or even water or aqueous solutions. Depending on the construction of the machine, the lubricant was applied directly through bores in the cavity, by spraying the bottom force or through lubricant-impregnated felt rings on the bottom forces. Raw material mixtures showing particularly favorable tabletting properties may not even require lubrication.

In order to avoid problems caused by sticking to the forces, it is advisable to coat the forces with plastics. Plexiglass or Vulkolan coatings have proved to be particularly favorable in this regard. However, favorable results have also been obtained with other standard materials.

The tabletting conditions were optimized to obtain the desired solubility profile coupled with adequate tablet hardness. The bending strength of the tablets may serve as a measure of their hardness (method: cf. Ritschel, "Die Tablette", Ed. Cantor, 1966, page 313). Tablets having a bending strength of greater than 12 kp and preferably greater than 15 kp are sufficiently stable under simulated transport conditions.

Corresponding tablet hardnesses were obtained for tabletting pressures of from 500 to 5000 kp/cm$^2$ and preferably from 100 to 1500 kg/cm$^2$. Higher tabletting pressures reduce the dissolving rate. With different compositions, solubility differences may be redressed within limits through the choice of the tabletting pressure (cf. Table 2, Example 3 and 4).

The specific gravity of the tablets varies in the layers according to the particular formulation. It is from 1 to 2 g/cm$^3$, preferably being from 1.2 to 1.4 g/cm$^3$ in the prerinse detergent layer, and from 1.4 to 1.7 g/cm$^3$ for the main-wash detergent layer. The specific gravity of the tablet as a whole is preferably from 1.35 to 1.55 g/cm$^3$.

The shape of the tablet can also affect its dissolving rate through the outer surface exposed to the water. For reasons of stability, tablets having a diameter-to-height ratio of from 0.6 to 1.5:1 and preferably 1:1 are produced.

The weight of a tablet may be varied as required within technically appropriate limits. 1, 2 or more tablets are used in dishwashing, depending on their size. Tablets weighing from 20 to 30 g are preferred, in which case 2 tablets have to be used. Larger tablets are generally more prone to break and, in addition, can only be formed at relatively low speeds, thus reducing output. With smaller tablets, the advantage over powder-form detergents in terms of handling (simple dispensing) would be reduced.

| Example (Table 2/Example 1) | | |
|---|---|---|
| Raw material | Layer 1 | Layer 2 |
| Sodium metasilicate, anhydrous, larger than 0.8 mm | — | 53.4 |
| Pentasodium triphosphate, anhydrous | — | 41.6 |
| Trichloroisocyanuric acid | — | 1.0 |
| Sodium acetate, anhydrous | 2.0 | 3.0 |
| $CaHPO_4.2\ H_2O$ | 1.0 | 1.0 |
| Sodium metasilicate nonahydrate | 38.4 | — |
| $C_{12}$-$C_{14}$-fatty alcohol + 5 EO + 4 PO | 1.52 | — |
| Alizarinbrillant, rein-blau, GLW | 0.08 | — |
| Sodium triphosphate hydrate (18% $H_2O$) | 57.0 | — |
| Weight/layer in grams | 6.3 | 18.7 |
| Density of the mixture, g/cm$^3$ | 0.89 | 0.8 |
| Tablet diameter, mm | 35.0 | |
| Tablet weight in grams | 25.0 | |

EO = moles ethylene oxide, PO = moles propylene oxide

First, the two detergent layers were prepared in a conventional mixture (Lodige, Forberg); in the case of layer 1 (for the prerinse cycle), the nonahydrate was sprayed before mixing with the nonionic surfactant containing the Alizarinbrillant, rein-blau, GLW.

The mixture was tabletted in a Fette "Exacta 31" eccentric press in which the tools had been coated with Vulkolan. To this end, the bottom force of the press was first moved into the lowest position in the cavity and the mixture of layer 1 introduced into the cavity. By turning the handwheel, the top force was then introduced into the bore of the cavity to such an extent that the material introduced to a height of 8.2 mm was precompressed to 6 mm. By turning the handwheel backwards, the top force was withdrawn from the cavity without the precompressed mass being ejected by the bottom force. The mixture of the second layer was then introduced into the matrix. Commensurate with the density of the first layer mixture of 0.89 g/cm$^3$, the second layer was introduced to a height of 21.8 mm. After the depth of penetration had been changed (by altering the eccentric setting), the tablet was compressed to a height of 17.3 mm. The height of the second layer in the tablet was 12.3 mm (density = 1.58 g/cm$^3$) and that of the first layer 2 mm (density = 1.31 g/cm$^3$). The compression ratio of the tablet as a whole was 1:1.73.

The pressure required for tabletting was 1400 kp/cm$^2$. The tablets obtained had a bending strength of greater than 15 kp. Approximately 22% of the tablet as a whole dissolved in the prerinse cycle. Layer 1 was virtually completely dissolved after the prerinse cycle. After the main-wash cycle, the tablet was completely dissolved. After storage, no cracks in the tablet or weathering of the surface were observed.

Many other tablets may be prepared by combining compositions 1-6 and 7-10 in Tables 1(a) and (b). Examples thereof are shown in Table 2.

Since there are not yet any suitable dispensers for this method of using dishwashing detergents in standard commercial dishwashing machines, the multi-layer detergent tablets may be introduced after opening the machines into a zone which exposes the tablets to the dissolving power of the stream of tapwater, for example into the cutlery basket of a domestic dishwashing machine, and the automatically controlled dishwashing process subsequently started.

Accordingly, the present invention also relates to the use of the multilayer detergent tablets for dishwashing in automatic domestic dishwashing machines, characterized in that the tablets are introduced after opening the machines into a zone which exposes the tablets to the dissolving power of the stream of cold tapwater, for example by placing in the cutlery basket, before the beginning of the prerinse cycle and the automatically controlled dishwashing process subsequently started.

TABLE 1a

Decomposition properties of tablets of different composition (in % by weight) for the prerinse cycle

| Composition | 1 | 2 | 3 | 4 | 5 | 6 |
|---|---|---|---|---|---|---|
| Na—metasilicate, anhydrous, smaller than 0.8 mm | — | — | — | — | — | |
| Na—metasilicate nonahydrate | — | 61.7 | 55.4 | — | 10 | — |
| $C_{12}$-$C_{18}$-fatty alcohol + 3 EO + 6 PO | — | — | — | — | — | 1.6 |
| Na—metasilicate, nonahydrate, blue | — | — | — | 41.6 | — | 38.4 |
| Na—triphosphate, anhydrous | — | 35.3 | — | — | — | — |
| Na—triphosphate hydrate (15% $H_2O$) | 97 | — | 41.6 | — | — | — |
| Na—triphosphate hydrate (18% $H_2O$) | — | — | — | 55.4 | 87 | 57.0 |
| Na—acetate, anhydrous | 2 | 2 | 2 | 2 | 2 | 2 |
| $CaHPO_4.2\ H_2O$ | 1 | 1 | 1 | 1 | 1 | 1 |
| Attapulgite | — | — | — | — | — | — |
| NaCl | — | — | — | — | — | — |
| Density | 1.34 | 1.28 | 1.21 | 1.26 | 1.22 | 1.27 |
| Hardness | >15 | 13 | 12 | >15 | >15 | >15 |
| Dissolved after minutes at 15° C. | 2.5 | 3.5 | 1 | 3 | 4 | 3 |
| Residue after 5 minutes at 15° C. | — | — | — | — | — | — |
| Residue after 10 minutes at 15° C. | — | — | — | — | — | — |

> = larger than

TABLE 1b

Decomposition properties of tablets of different composition (in % by weight) for the main-wash cycle

| Composition | 7 | 8 | 9 | 10 |
|---|---|---|---|---|
| Na—metasilicate, anhydrous, smaller than 0.8 mm | 33 | 58.4 | 61 | 45 |
| Na—metasilicate nonahydrate | 28 | — | — | 51 |
| Na—metasilicate nonahydrate, blue | — | — | — | — |
| Na—triphosphate, anhydrous | 35 | 41.6 | 35 | — |
| Na—triphosphate hydrate (15% $H_2O$) | — | — | — | — |
| Na—triphosphate hydrate (18% $H_2O$) | — | — | — | — |
| Trichloroisocyanuric acid | 1 | 1 | 1 | 1 |
| Na—acetate, anhydrous | 2 | 3 | 2 | 2 |
| $CaHPO_4.2\ H_2O$ | 1 | 1 | 1 | 1 |
| Attapulgite | — | — | — | — |
| NaCl | — | — | — | — |
| Density | 1.63 | 1.58 | 1.57 | 1.52 |
| Hardness | >15 | >15 | 13 | 12 |
| Dissolved after minutes at 15° C. | >20 | >20 | >20 | >20 |
| Residue after 5 minutes at 15° C. | 90 | 94 | 88 | 95 |
| Residue after 10 minutes at 15° C. | 85 | 90 | 81 | 90 |

> = larger than

TABLE 2

| Examples of two-layer tablets (quantities in % by weight) | | | | | | | | |
|---|---|---|---|---|---|---|---|---|
| Example | 1 | | 2 | | 3 | | 4 | |
| layer | 1 | 2 | 1 | 2 | 1 | 2 | 1 | 2 |
| Na—metasilicate, anhydrous, smaller than 8 mm | — | 53.4 | | 33 | | 53.4 | | 53.4 |
| Na—metasilicate nonahydrate | — | — | — | 28 | — | — | — | — |
| $C_{12}$–$C_{18}$ fatty alcohol + 3 EO + 6 PO | 1.6 | — | — | — | — | — | — | — |
| Metasilicate nonahydrate, blue | 38.4 | — | 40 | — | 40 | — | 40 | — |
| Na—triphosphate, anhydrous | — | 41.6 | — | 35 | — | 41.6 | — | 41.6 |
| Na—triphosphate hydrate (18% $H_2O$) | 57.0 | — | 57 | — | 57 | — | 57 | — |
| Trichloro-isocyanuric acid | — | 1 | — | 1 | — | 1 | — | 1 |
| Na—acetate, anhydrous | 2 | 3 | 2 | 2 | 2 | 3 | 2 | 3 |
| $CaHPO_4.2\ H_2O$ | 1 | 1 | 1 | 1 | 1 | 1 | 1 | 1 |
| Weight/layer g | 6.3 | 18.7 | 5 | 20 | 6.3 | 15.8 | 6.3 | 18.7 |
| Tablet height mm | 17.3 | | 17.5 | | 16.8 | | 18.5 | |
| Tablet diameter mm | 35 | | 35 | | 35 | | 35 | |
| Density g/cm$^3$ | 1.50 | | 1.49 | | 1.37 | | 1.41 | |
| Bending strength kp | >15 | | >15 | | >15 | | >15 | |
| % total tablet dissolved after prerinse | 22 | | 25 | | 39 | | 26 | |
| % layer 1 dissolved | 98 | | 95 | | 95 | | 95 | |
| % dissolved after full dishwashing program | 100 | | 100 | | 100 | | 100 | |

> = larger than

We claim:

1. A multilayer detergent tablet for dishwashing machines based on alkaline components selected from the group consisting of alkali metal metasilicates and pentaalkali metal triphosphates; an active chlorine compound; and surfactant; said tablet comprising a first cold water-soluble layer of alkali metal metasilicate nonahydrate and pentaalakli metal triphosphate containing from about 7 to about 22.4% by weight water of crystallization in a weight ratio of from 0.35:1 to 1:1, based on anhydrous compounds, and from about 1 to about 5% by weight of a low-foaming nonionic surfactant; and a second layer which dissolves rapidly at increasing water temperaures comprising from about 88 to about 98% by weight of anhydrous alkali metal metasilicate and pentaalkali metal triphosphate in a weight ratio of from about 2:1 to 1:2, based on anhydrous compounds, and from about 0.5 to about 5% by weight of an active chlorine compound, said first layer having a specific gravity of from about 1.2 to about 1.4 g/cm$^3$, and said second layer having a specific gravity of from about 1.4 to about 1.7 g/cm$^3$.

2. A mulilayer detergent tablet in accordance with claim 1 wherein said tablet contains as tabletting aids, from about 0.5 to about 2.5% by weight of calcium hydrogen phosphate dihydrate and from about 1 to about 5% by weight of anhydrous sodium acetate, based on the weight of said tablet.

3. A multilayer detergent tablet in accordance with claim 1 wherein said first layer is colored.

4. A multilayer detergent tablet in accordance with claim 1 wherein said alkali metal metasilicate nonahydrate is colored.

5. A multilayer detergent tablet in accordance with claim 1 wherein said alkali metal metasilicate present in said second layer is a mixture of anhydrous metasilicate and metasilicate nonahydrate.

6. A multilayer detergent tablet in accordance with claim 1 wherein said pentaalkali metal triphosphate present in said second layer is anhydrous.

7. A multilayer detergent tablet in accordance with claim 1 wherein said tablet has a specific gravity of from about 1.35 to about 1.55 g/cm$^3$.

8. A dishwashing process comprising adding to a dishwashing machine a multilayer detergent tablet based on alkaline components selected from the group consisting of alkali metal metasilicates and pentaalkali metal triphosphates; an active chlorine compound; and surfactant; said tablet comprising a first cold water-soluble layer of alkali metal metasilicate nonahydrate and pentraalkali metal triphosphate containing from about 7 to about 22.4% by weight water of crystallization in a weight ratio of from 0.35:1 to 1:1, based on anhydrous compounds, and from about 1 to about 5% by weight of a low-foaming nonionic surfactant; and a second layer which dissolves rapidly at increasing water temperatures comprising from about 88 to about 98% by weight of anhydrous alkali metal metasilicate and pentaalkali metal triphosphate in a weight ratio of from about 2:1 to 1:2, based on anhydrous compounds, and from about 0.5 to about 5% by weight of an active chlorine compound, said first layer having a specific gravity of from about 1.2 to about 1.4 g/cm$^3$, and said second layer having a specific gravity of from about 1.4 to about 1.7 g/cm$^3$.

9. A process in accordance with claim 8 wherein said tablet contains as tabletting aids, from about 0.5 to about 2.5% by weight of calcium hydrogen phosphate dihydrate and from about 1 to about 5% by weight of anhydrous sodium acetate, based on the weight of said tablet.

10. A process in accordance with claim 8 wherein said first layer is colored.

11. A process in accordance with claim 8 wherein said alkali metal metasilicate present in said second layer is a mixture of anhydrous metasilicate and metasilicate nonahydrate.

12. A process in accordance with claim 8 wherein said pentaalkali metal triphosphate present in said second layer is anhydrous.

* * * * *